United States Patent [19]

Casci

[11] 3,977,715

[45] Aug. 31, 1976

[54] PICKUP KIT FOR ANIMAL DROPPINGS

[75] Inventor: David A. Casci, Palo Alto, Calif.

[73] Assignee: The Raymond Lee Organization, Inc., New York, N.Y. ; a part interest

[22] Filed: Apr. 28, 1975

[21] Appl. No.: 572,276

[52] U.S. Cl. ..... 294/19 R; 294/1 R; 294/99 R

[51] Int. Cl.[2] ..... A01K 29/00; A47L 13/52

[58] Field of Search ..... 294/1 R, 8.5, 11, 16, 294/19 R, 19 A, 33, 50.6, 50.8, 50.9, 51, 52, 55, 99 R, 106; 15/104.8, 257.1, 257.2, 257.4, 257.6, 257.7, 257.9; 56/332, 333, 400.11, 400.12, 400.13

[56] References Cited

UNITED STATES PATENTS

| | | | |
|---|---|---|---|
| 1,207,488 | 12/1916 | Brock | 294/51 X |
| 1,862,625 | 6/1932 | Kerr | 294/99 R |
| 2,189,713 | 2/1940 | Hansen | 294/19 R |
| 2,305,950 | 12/1942 | Birch | 294/55 |
| 2,649,604 | 8/1953 | Hess | 15/257.1 X |
| 3,676,887 | 7/1972 | Klein | 15/104.8 |
| 3,692,347 | 9/1972 | Bixler | 294/50.8 X |
| 3,778,097 | 12/1973 | Dorzan | 294/1 R X |
| 3,804,448 | 4/1974 | Schmieler | 294/19 R |
| 3,810,670 | 5/1974 | Turi | 294/19 R |

*Primary Examiner*—Johnny D. Cherry
*Attorney, Agent, or Firm*—Daniel Jay Tick

[57] ABSTRACT

An elongated rod-like handle member has a pair of opposite first and second ends. A sleeve-like member is affixed to the first end of the handle member in perpendicular relation thereto. A disposable bag is removably accommodated in the sleeve-like member and maintained thereby in open condition. The bag has an open mouth with an edge and a rigid plate-like collar projecting outward from the edge. An elongated rod-like shovel handle has a pair of first and second ends with a clamping member affixed to the first end thereof. A disposable shovel member is releasably clamped by the clamping member for shoveling animal droppings into the bag.

2 Claims, 4 Drawing Figures

PICKUP KIT FOR ANIMAL DROPPINGS

DESCRIPTION OF THE INVENTION

The present invention relates to a pickup kit for animal droppings.

Objects of the invention are to provide a pickup kit for animal droppings, which kit is of simple structure, inexpensive in manufacture, used with facility and convenience, eliminates animal droppings without fuss and bother in a completely hygienic manner and with efficiency, effectiveness and reliability.

In order that the invention may be readily carried into effect, it will now be described with reference to the accompanying drawing, wherein.

Figure 1:
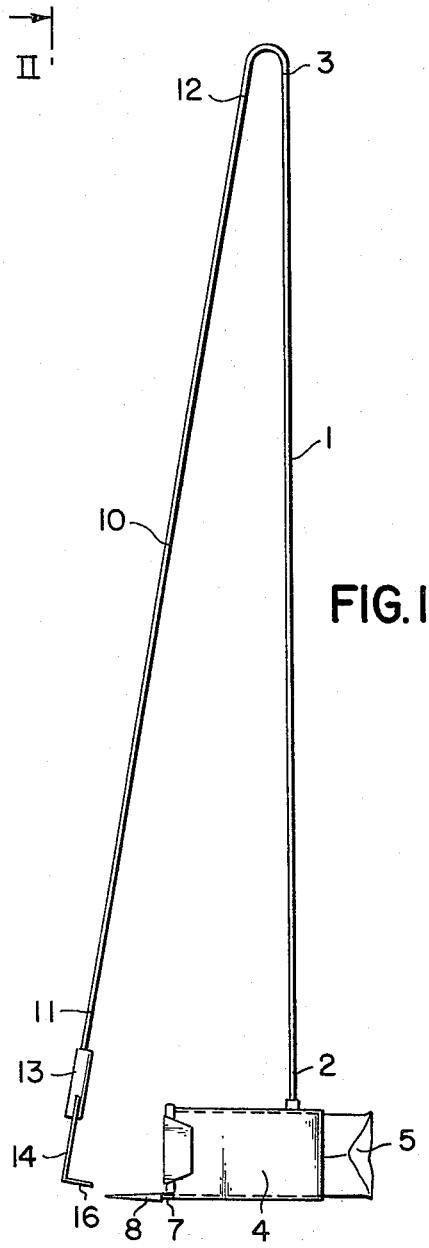
FIG. 1 is a view of an embodiment of the pickup kit of the invention for animal droppings.

The pickup kit of the invention comprises an elongated rod-like handle member 1 having a pair of opposite first and second ends 2 and 3 (FIG. 1).

A sleeve-like member 4 (FIGS. 1 and 2) is affixed to the first end 2 of the handle member 1 in substantially perpendicular relation thereto.

Figure 3:
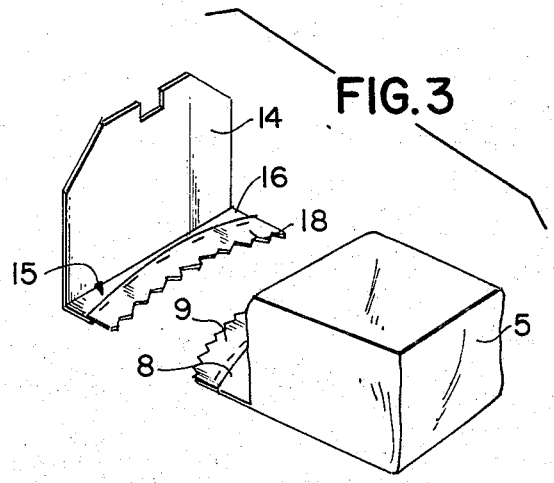
FIG. 3 is a perspective view illustrating the use of the pickup kit of the invention.
Figure 4:
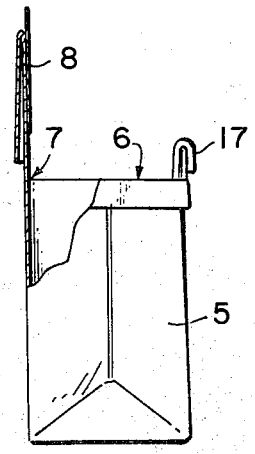
FIG. 4 is a view, partly cutaway, and partly in section, on an enlarged scale, of part of the pickup kit of the invention.

A disposable bag 5 (FIGS. 1, 3 and 4) is removably accommodated in the sleeve-like member 4 and maintained thereby in open condition. The bag 5 has an open mouth 6 (FIG. 4) with an edge 7 (FIGS. 1 and 4). A substantially rigid substantially plate-like blade-type collar 8 projects outward from the edge 7 of the bag 5. The collar 8 may have a serrated edge 9 extending therefrom, as shown in FIG. 3.

Figure 2:
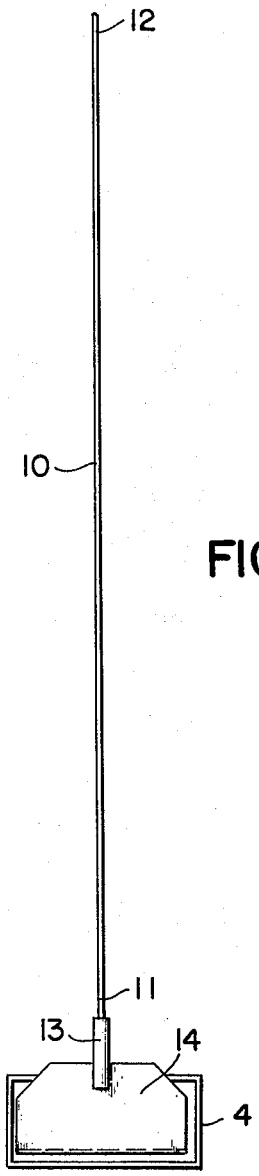
FIG. 2 is a view, taken along the lines II—II, of FIG. 1.

An elongated rod-like shovel member 10 (FIGS. 1 and 2) has a pair of first and second ends 11 and 12 (FIGS. 1 and 2).

A clamping member 13 (FIGS. 1 and 2) is affixed to the first end 11 of the shovel handle 10. A disposable shovel member 14 (FIGS. 1 to 3) is releasably clamped by the clamping member 13 for shoveling animal droppings into the bag 5. The shovel member 14 comprises a substantially rigid plate-like member having an edge 15 (FIG. 3) and a substantially rigid blade-type collar 16 (FIGS. 1 and 3) projecting from said edge substantially perpendicularly from the plate-like member.

The shovel member 14 preferably comprises cardboard, plastic, or the like. The bag 5 preferably comprises a plastic bag, a paper bag having a plastic lining, or the like. The bag 5 may be equipped with a hook 17 (FIG. 4) for clipping it to the top of the sleeve-like member 4. The collar 16 may have a serrated edge 18 extending therefrom (FIG. 3).

In a preferred embodiment of the invention, the handle member 1 and the shovel handle 10 are affixed to each other at the second ends 3 and 12, respectively, thereof to form a single substantially resilient substantially V-shaped rod, as shown in FIG. 1.

After droppings are shoveled into the bag 5 with the shovel member 10, the shovel member is placed in the bag, and the bag and its contents are disposed of.

While the invention has been described by means of a specific example and in a specific embodiment, I do not wish to be limited thereto, for obvious modifications will occur to those skilled in the art without departing from the spirit and scope of the invention.

I claim:

1. A pickup kit for animal droppings, said pickup kit comprising an elongated rod-like handle member having a pair of opposite first and second ends;

a sleeve-like member affixed to the first end of the handle member in substantially perpendicular relation thereto;

a disposable bag removably accommodated in the sleeve-like member and maintained thereby in open condition, said bag having an open mouth with an edge and a substantially rigid substantially plate-like blade-type collar projecting outward from the edge;

an elongated rod-like shovel handle having a pair of first and second ends, the shovel handle and the handle member being affixed to each other at the second ends thereof to form a single substantially resilient substantially V-shaped rod;

a clamping member affixed to the first end of the shovel handle; and a disposable shovel member releasably clamped by the clamping member for shoveling animal droppings into the bag.

2. A pickup kit as claimed in claim 1, wherein the shovel member comprises a substantially rigid plate-like member having an edge and a substantially rigid blade-type collar projecting from the edge substantially perpendicularly from the plate-like member.

* * * * *